US007524095B2

(12) United States Patent
Albou et al.

(10) Patent No.: US 7,524,095 B2
(45) Date of Patent: Apr. 28, 2009

(54) HEADLIGHT FOR A MOTOR VEHICLE WITH A COMBINED MIRROR AND DEFLECTION ELEMENTS AND THEIR METHOD OF MANUFACTURE

(75) Inventors: Pierre Albou, Bobigny Cedex (FR); Herve Perrin, Bobigny Cedex (FR)

(73) Assignee: Valeo Vision (FR)

( * ) Notice: Subject to any disclaimer, the term of this patent is extended or adjusted under 35 U.S.C. 154(b) by 0 days.

(21) Appl. No.: 10/103,631

(22) Filed: Mar. 20, 2002

(65) Prior Publication Data

US 2002/0186570 A1 Dec. 12, 2002

(30) Foreign Application Priority Data

Mar. 21, 2001 (FR) ..... 01 03906

(51) Int. Cl.
*F21S 8/10* (2006.01)

(52) U.S. Cl. ..... 362/520; 362/507; 362/538

(58) Field of Classification Search ..... 362/520, 362/485, 487, 507, 514, 518, 522, 538, 309, 362/308, 328, 304, 297, 305
See application file for complete search history.

(56) References Cited

U.S. PATENT DOCUMENTS

| | | | | |
|---|---|---|---|---|
| 1,471,166 | A * | 10/1923 | Jones | 362/304 |
| 1,991,866 | A * | 2/1935 | Rich | 362/520 |
| 4,459,644 | A * | 7/1984 | Bailly | 362/80 |
| 4,530,042 | A * | 7/1985 | Cibie et al. | 362/309 |
| 4,772,988 | A * | 9/1988 | Brun | 362/518 |
| 5,086,376 | A * | 2/1992 | Blusseau | 362/61 |
| 5,132,847 | A * | 7/1992 | Collot | 359/678 |
| 5,192,124 | A * | 3/1993 | Kawashima et al. | 362/61 |
| 5,204,820 | A | 4/1993 | Strobel et al. | 364/468 |
| 5,258,897 | A | 11/1993 | Nino | 362/346 |
| 5,440,456 | A | 8/1995 | Bertling et al. | 362/61 |
| 5,544,021 | A * | 8/1996 | Lopez et al. | 362/518 |
| 6,024,473 | A | 2/2000 | Fadel | 362/516 |

(Continued)

FOREIGN PATENT DOCUMENTS

DE 4 200 989 8/1992

(Continued)

OTHER PUBLICATIONS

English Language Abstract of DE 100 37 197 A, Feb. 8, 2001.

(Continued)

*Primary Examiner*—Sharon E Payne
(74) *Attorney, Agent, or Firm*—Locke Lord Bissel & Liddell LLP

(57) ABSTRACT

A headlight for a motor vehicle comprises a light source, a mirror and a transparent optical deflection element placed in front of the mirror, the mirror being capable of cooperating with the light source in order to generate a beam delimited by an upper cut-off line, and the deflection element being capable of providing a generally horizontal spread of the light, without substantially modifying the vertical distribution of the light.

This headlight is noteworthy in that the said deflection element has light input and output faces which are continuous over their entire span.

It thus presents an appearance similar to that of a headlight of the elliptical type with a lens.

11 Claims, 4 Drawing Sheets

U.S. PATENT DOCUMENTS

| | | | | |
|---|---|---|---|---|
| 6,102,558 | A * | 8/2000 | Farnoux | 362/518 |
| 6,382,822 | B1 * | 5/2002 | Maekawa et al. | 362/522 |

FOREIGN PATENT DOCUMENTS

| | | |
|---|---|---|
| FR | 2 760 067 | 8/1998 |
| FR | 2 760 068 | 8/1998 |
| FR | 2 773 604 | 7/1999 |
| JP | 56-124901 | 9/1981 |
| JP | 58-178201 | 11/1983 |
| JP | 3-122902 | 5/1991 |
| JP | 7-41814 | 7/1995 |
| JP | 7-296609 | 11/1995 |

OTHER PUBLICATIONS

French Search Report, Mar. 14, 2002.

Donohue, R.J. and Joseph, B.W., 1975, "Computer Synthesized Filament Images From Relectors And Through Lens Elements For Lamp Design and Evaluation", Applied Optics, vol. 14(10), pp. 1-7.

* cited by examiner

HEADLIGHT FOR A MOTOR VEHICLE WITH A COMBINED MIRROR AND DEFLECTION ELEMENTS AND THEIR METHOD OF MANUFACTURE

The present invention relates, in general, to headlights for motor vehicles.

At present, there are two large families of such headlights. The first family, those of headlights herein called "of the parabolic type" comprises headlights whose beam is mainly generated by a source of small dimensions mounted in a mirror which projects the rays onto the road in order to form the desired beam. The window of the headlight is involved, if necessary, by being fitted with prisms, striations, etc. in order to model the beam, and in particular, in order to spread it widthwise. In this case, this family includes the headlights called "free-surface" or else "Surface Complexe" (registered trademark) headlights, having the ability of directly generating a beam delimited by a desired upper cut-off line.

These headlights have the properties of being able to generate beams of excellent quality in terms of light distribution, and of being, in general, not very deep; however, in order to generate a sufficiently intense beam, it is necessary that their mirror recovers a significant proportion of the light flux emitted by the lamp.

A first approach to doing this consists in using a very small initial focal length, especially in order to obtain a mirror which is very close around the source and of small size widthwise. However, in this case, because of the large size of the images of the source generated by the mirror, the beam has in general an excessive thickness, and is in any case difficult to control.

A second approach to recovering the light flux while obtaining a thinner beam consists, on the contrary, in increasing the initial focal length, but in this case the mirror must have relatively large dimensions transversely to the optical axis, which is counter to the objective of a compact headlight.

The second family is that of headlights "of the elliptical type". Such headlights are characterized by a lamp mounted in a mirror which generates, with the reflected rays, a concentrated spot (typically, the source is at the first focus of a mirror in the shape of an ellipsoid of revolution and the spot is formed at the second focus of the said mirror), and this spot is projected onto the road by a convergent lens, usually a plano-convex lens. If the beam has to comprise a cut-off line, the latter is produced by partly occluding the light spot where it is formed.

This second family of headlights has the advantage of being able to recover a significant proportion of the light flux emitted by the source, while having small dimensions transversely to the optical axis. On the other hand, the photometry of the beam may prove to be difficult to model, since by nature no correcting element of the prism or striated type can in general correct the light downstream of the lens; furthermore, these headlights have a large size depthwise.

Furthermore, in practice, these two families of headlights have very different external appearances.

Thus, the headlights of the parabolic type have a window with a relatively large width (while throughout the years, for reasons of style and aerodynamics, their height has gradually reduced). This window is striated or, in more recent styles, virtually smooth such that, when the headlight is extinguished, the mirror and various types of trims are observed perfectly on the inside.

In contrast, a headlight of the elliptical type, when it is extinguished, in general reveals only the outer convex face of the lens, which is often surrounded with a suitable trim, through a smooth window.

Nowadays, there are ever more demanding requests from designers relating to the appearance of illuminating headlights for vehicles.

Thus certain style "trends" favour headlights of parabolic type, or of elliptical type, or even a combination of both types.

Moreover, on a more technical level, there is a strong demand for headlights having a size which is moderate not only transversely to the optical axis, but also depthwise, that is to say along the optical axis, which, in principle, neither of the two families of headlights mentioned above is able to obtain without making concessions in terms of quality of illumination.

Of course there have been attempts to produce headlights of the parabolic family which have a height and a width comparable to those of an elliptical headlight (that is to say, each one typically less than 100 mm, or even 90 mm), while forming a suitable beam, although limited in terms of light intensity, especially along the axis of the road.

However, a sidelight of this sort placed alongside a headlight of the elliptical type (for example, one being responsible for dipped-lighting while the other is responsible for road lighting) will have—with the headlights extinguished—an aesthetic appearance which is very different from that of the said elliptical headlight, which today no longer satisfies the designers.

The present invention therefore aims to provide a headlight which, while technically belonging to the family of headlights "of the parabolic type", has, when extinguished, an external appearance similar to that of a headlight "of the elliptical type".

Another object of the present invention is to satisfy this objective while generating a light beam of high quality.

To this end, the present invention provides, according to a first aspect, a headlight for a motor vehicle, comprising a lightsource, a mirror and a transparent optical deflection element placed in front of the mirror, the mirror being capable of cooperating with the light source in order to generate a beam delimited by an upper cut-off line, and the deflection element being capable of providing a generally horizontal spread of the light, without substantially modifying the vertical distribution of the light, a headlight characterized in that the said deflection element has light input and output faces which are continuous over their entire span, so as to present an appearance similar to that of a lens for projecting a light spot.

Preferred, but non-limiting, aspects of the headlight according to the invention are as follows:

- The light input and output faces of the deflection element are smooth.
- The deflection element has a generally circular outline.
- The mirror has an outline chosen so that all the light rays coming from the source and reflected by the mirror encounter the input face of the deflection element.
- The mirror has a horizontal generatrix satisfying a predetermined law expressing a second lateral distance, from an optical axis of the headlight, of the location of impact of a reflected ray on a transverse reference line located near the deflection element, as a function of a first lateral distance, from this same optical axis, of the location of reflection of the said reflected ray on the said horizontal generatrix.
- The second lateral distance varies in a non-linear manner from zero to a maximum of the said second lateral distance when the first lateral distance varies from zero to a maximum of the said first lateral distance.

The maxima of the first lateral distance and of the second lateral distance are substantially equal, thereby giving substantially the same width to the mirror and to the deflection element.

For at least one interval of values of the first lateral distance, the second lateral distance is zero.

For a defined interval of values of the first lateral distance, the second lateral distance varies monotonically in another interval of values.

The said variation is linear.

The deflection element has a horizontal cross section satisfying a predetermined law expressing a horizontal angular deflection of the lateral light, from an optical axis of the headlight, of a ray reflected by the mirror, as a function of a first lateral distance, from this same optical axis, of the location of reflection of the said reflected ray on the said horizontal generatrix.

For a lateral half of the headlight, the sign of the lateral deflection defined by the said pre-determined law remains the same.

For at least one interval of values of the first lateral distance, the horizontal angular deflection varies monotonically within an interval of values.

One of the faces of the deflection element is flat.

The flat face is orthogonal to an optical axis of the headlight.

According to a second aspect of the present invention, a pair of headlights for a motor vehicle, the headlights being intended to be located one near the other at the front of the vehicle, characterized in that it comprises a headlight as defined above and a headlight of the elliptical type, the deflection element of the headlight as defined above being near a projection lens of the headlight of the elliptical type is provided.

The invention finally proposes a method of manufacturing a mirror and a deflection element combined with a motor vehicle headlight, the headlight comprising a light source, a mirror and a transparent optical deflection element placed in front of the mirror, the mirror being capable of cooperating with the lamp in order to generate a beam delimited by an upper cut-off line, and the deflection element being capable of providing a generally horizontal spread of the light, without substantially modifying the vertical distribution of the light, a method characterized in that it comprises the following steps:

establishing a first law expressing a second lateral distance, from an optical axis of the headlight, of the location of impact of a reflected ray on a transverse reference line located near the deflection element, as a function of a first lateral distance, from this same optical axis, of the location of reflection of the said reflected ray on a horizontal generatrix of the mirror, determining the horizontal generatrix of the mirror from this first law, mathematically constructing a reflecting surface of the mirror from the said horizontal generatrix and as a function of a vertical cut-off line desired for the beam, machining an impression, from the mathematical construction of the reflecting surface, in order to manufacture the mirror with the said reflecting surface, manufacturing the mirror using the said impression, establishing a second law expressing a horizontal angular deflection, from the optical axis of the headlight, of the ray reflected by the mirror, as a function of the said first lateral distance, determining a horizontal cross section of the deflection element from this second law, mathematically constructing light input and output surface of the deflection element, from this horizontal cross section, machining a mould, from the mathematical construction of the input and output surfaces, for the manufacture of the deflection element with the said input and output faces, and manufacturing the deflection element by using the said mould.

Other aspects, aims and advantages of the present invention will become better apparent on reading the following detailed description of a preferred embodiment thereof, given by way of non-limiting example and made with reference to the appended drawings, in which:

FIG. 1 illustrates schematically, by means of an axial horizontal section, the principle of construction of a mirror and of a lens of a headlight according to the invention.

FIGS. 2*a* and 2*b* illustrate, respectively, two curves of behaviour illustrating a particular design example of the mirror and of the optical element of a headlight according to the invention.

By way of introduction, it will be noted that, in the following description, reference will be made to an orthonormal frame of reference where O is at the geometric centre of the source 10, x-x is the horizontal axis transverse to the optical axis of the headlight, y-y is the optical axis, and z-z is vertical.

It will also be noted that the design of the headlight will be given below for only a lateral half thereof, knowing that the other half will be constructed with the same information, whether symmetrically or not.

Figure 1:
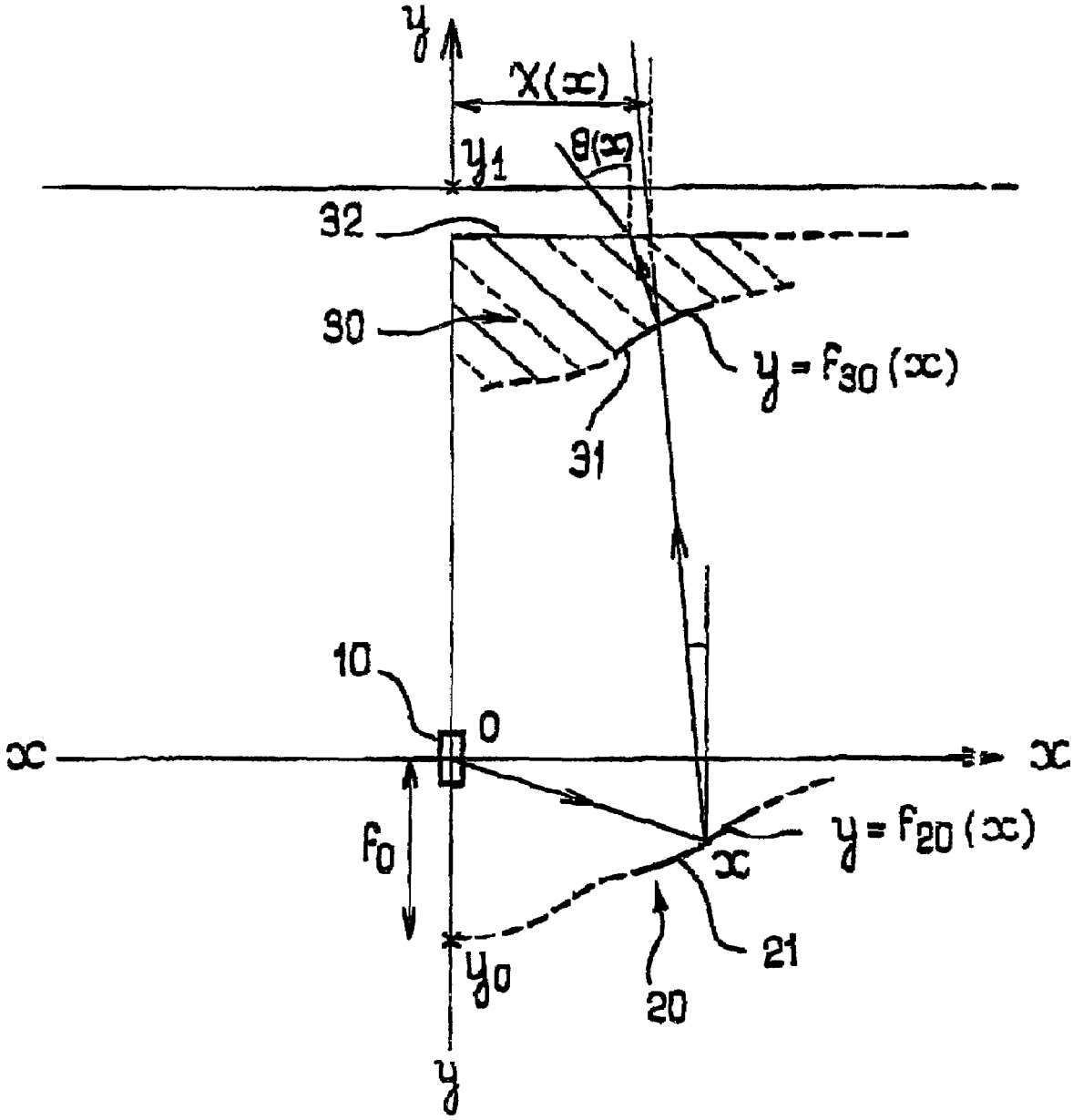

With reference first of all to FIG. 1, a headlight according to the invention mainly comprises a lamp housing a light source such as a filament (incandescent lamp) or a light arc (gas discharge lamp), a mirror 20 and an optical deflection element 30, which in this case will be called a "lens".

The structural details of this headlight, which may be completely conventional, have not been shown for the sake of simplification. In particular, the elements illustrated in FIG. 1 may be housed in a box closed at the front by a completely smooth window.

In this case, the source 10 is placed axially along the optical axis y-y of the mirror 20, the horizontal generatrix 21 of which describes a curve $y=f_{20}(x)$ as will be explained below.

The lens 30 is placed transversely to the OY axis and has an inner face 31 receiving the light reflected by the mirror and an outer face 32 which, in this case, is smooth, flat and perpendicular to OY. The inner face 31 of the lens has a horizontal cross section describing a curve, which is continuous and preferably derivable, $y=f_{30}(x)$, as will be explained below, the lens being obtained by displacement of a vertical directrix along this curve in order to form its inner face, the lens thus being cylindrical.

In the present example, the mirror 20 is capable of generating a light beam delimited overall by an upper cut-off line.

In the prior art, there are many publications describing mirrors of this sort, and in particular mirrors capable of generating a beam provided with a cut-off line of this sort, whatever the generatrix $y=f_{20}(x)$ which is chosen. Reference will especially be made to the document DE-A-4 200 989, which describes in detail a generic method for producing such surfaces mathematically from any horizontal generatrix.

It will be noted below that D/2 is the half-width of the mirror 20 and of the lens 30.

The mirror 20 and the inner face 31 of the lens 30 are constructed as a function of the behaviour desired thereof in terms of reflected and refracted ray propagation, respectively.

In particular, the horizontal generatrix of the mirror is first of all constructed so as to satisfy a given law which gives, as a function of x, the value $\chi(x)$ along x of the point of impact, on an imaginary transverse line of equation $y=y_1$ in the plane of FIG. 1, of the light ray reflected at the point x of the horizontal generatrix of the mirror.

It is understood that a law of this sort makes it possible to model various forms of horizontal generatrices.

Thus, for example, a law which gives $\chi(x)=0_1$, whatever the value of x, describes an elliptical horizontal generatrix, the first focus of which is at the point 0 and the second focus of which is on the y-y axis at $y=y_1$. According to another example, it is understood that a law which gives $\chi(x)=x$ gives a parabolic horizontal generatrix of focus 0.

From this, it is also understood that the law which is chosen makes it possible to control the way in which the mirror "closes" around the source, that is to say, to control the amount of light flux recovered by the mirror, it being understood that the focal length $f_0$ between the point 0 and the bottom of the mirror 20 at $y_0$ also makes it possible to vary this flux recovery.

Figure 2A:
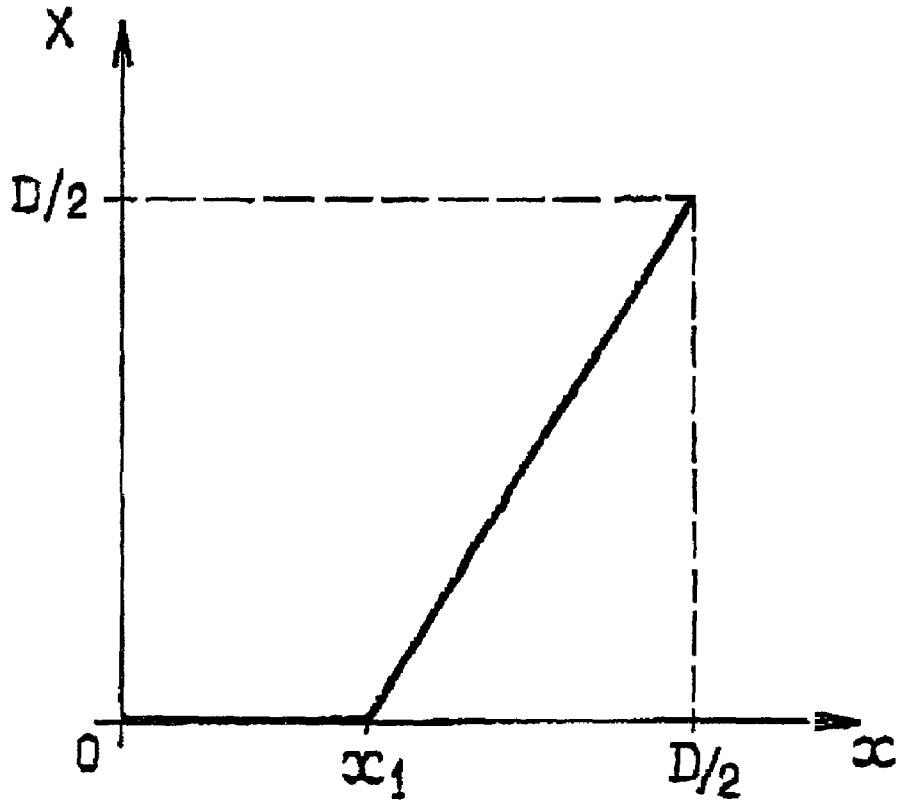

A particular example of a law of this sort is given in FIG. 2*a* of the drawings. It will be observed that the horizontal generatrix of the mirror has an elliptical shape ($\chi(x)=0$) from 0 to $x=x_1$. Next, between $x_1$ and the maximum value x=D/2, the point of impact of the reflected ray is gradually offset from $\chi=0$ to $\chi=D/2$, which corresponds to the extreme lateral value of the lens 30.

As a result, it is understood that the horizontal generatrix of the mirror changes gradually, from $x_1$ with an elliptical shape towards a shape which is somewhat parabolic.

The curve $y_{20}(x)$, which defines the horizontal generatrix, and therefore the whole of its three-dimensional shape according to the teachings of the documents mentioned above, may be easily defined as a function of a law such as that shown in FIG. 2*a* of the drawings, by means of a system of differential equations in canonical form, within the scope of a person skilled in the art.

It is important that the majority, or even all, of the radiation reflected by the mirror properly reaches the input face of the lens. This is easily achieved by making sure, when choosing the law $\chi(x)$, that the value of $\chi(x)$ never exceeds D/2.

The shape of the inner horizontal cross section of the lens, defined by the curve $y=f_{30}(x)$, is itself defined from a chosen law which determines, as a function of the value x for transmission of a ray reflected by the generatrix 21 of the mirror (which itself makes it possible to determine the initial horizontal deflection of the ray from the optical axis y-y, by knowing the shape of the said generatrix), the final horizontal deflection $\theta(x)$ imparted to this ray.

It will be noted here that, by convention, deflections towards the left are allocated a negative sign.

Figure 2B:
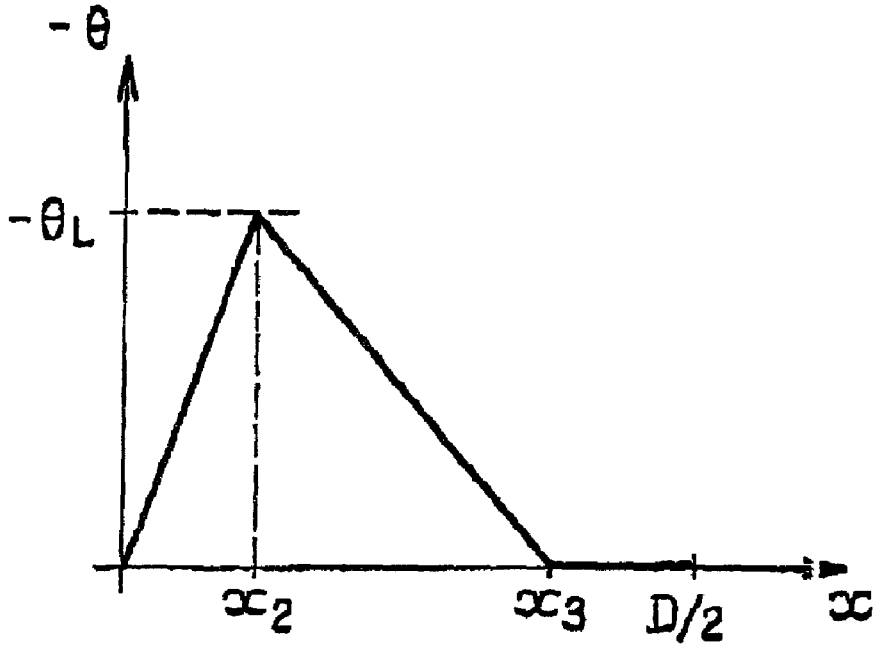
Figure 4:
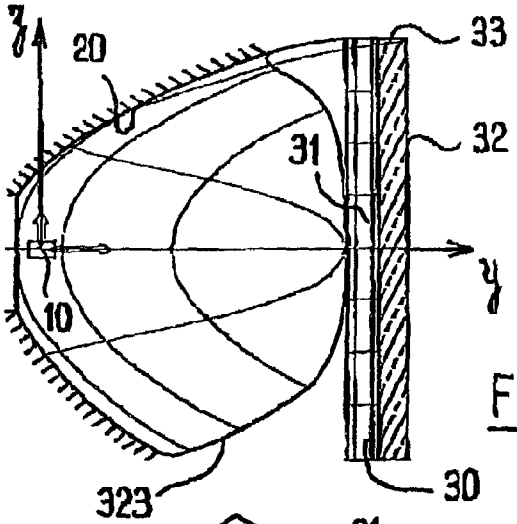
FIG. 4 is a schematic view in axial vertical section of the headlight example of FIG. 3.
Figure 6:
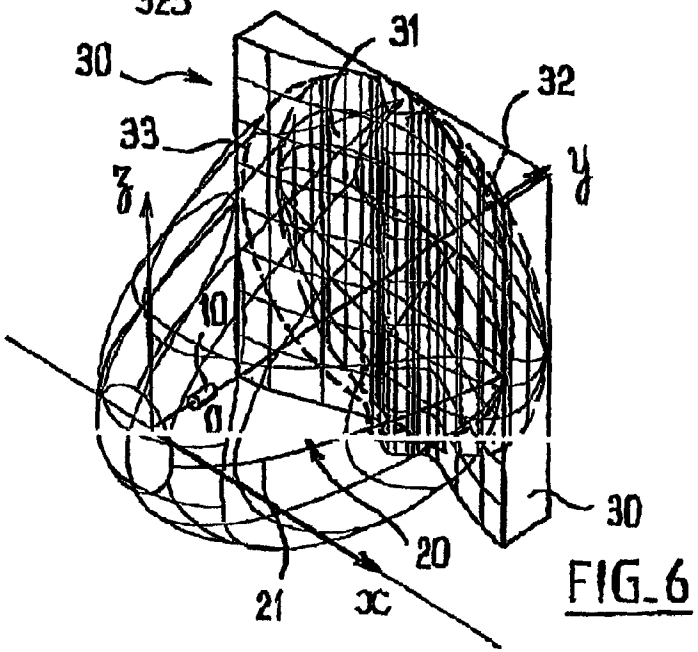
FIG. 6 is a perspective view with lines tracing the mirror and the lens of the headlight of FIGS. 3 to 5.
Figure 3:
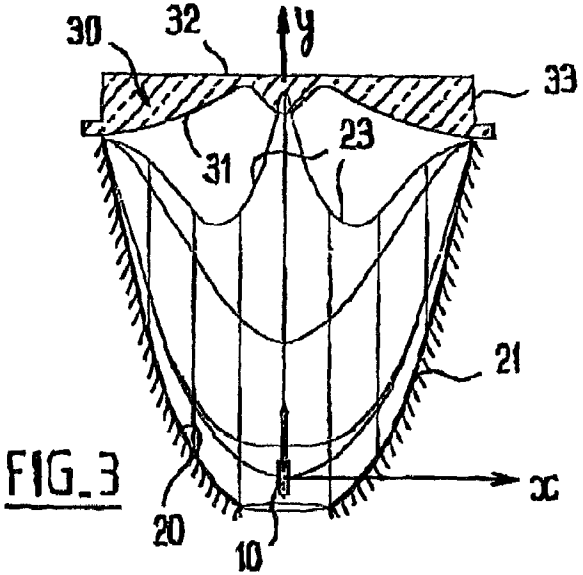
FIG. 3 is a schematic view in axial horizontal section of an example of a headlight according to the invention constructed according to this principle.
Figure 5:
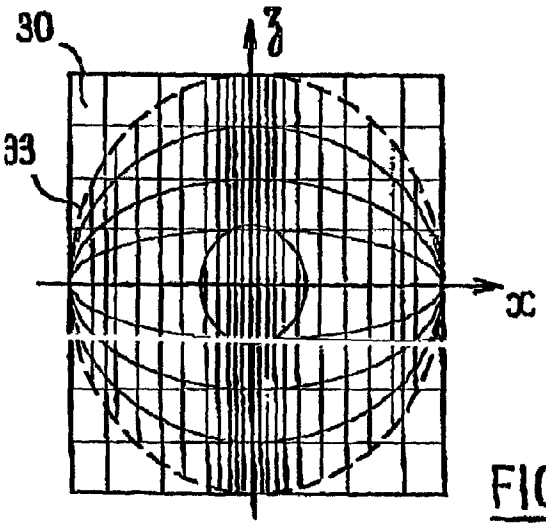
FIG. 5 is a front view of the optical element of the headlight of FIGS. 3 and 4.

Thus, FIG. 2*b* illustrates a particular example of a law of this sort where:

between the values 0 and $x_2$, the deflection goes gradually from 0 (undeflected ray) to a maximum deflection $-\theta_L$;

between the values $x_2$ and $x_3$, the deflection goes gradually from the maximum value $-\theta_L$ to zero, and between the value $x_3$ and the extreme value D/2, the deflection remains zero.

It will be observed here that the choice of $\theta(x)=0$ for x=0 makes it possible to ensure that at the value x=0, the input face of the lens 30 has a cross section which can be differentiated (in this case, perpendicular to the optical axis y-y).

Here again, the horizontal cross section $y=f_{30}(x)$ of the inner face 31 of the lens can be easily determined by a person skilled in the art as a function of the law $\theta(x)$ which was chosen, for example using a system of differential equations in canonical form.

Thus, the combination of the laws of FIGS. 2*a* and 2*b* makes it possible to design a mirror and a lens by adjusting, on the one hand, the horizontal deflection of the radiation imparted by the mirror, and therefore the recovery by the same mirror of the light flux emitted by the source 10 and, on the other hand, the horizontal deflection of the radiation imparted by the lens 30.

From the numerical files thus obtained, a computer-assisted machining process can be implemented to produce the moulds or imprints serving to manufacture, on the one hand, the mirror, and on the other, the lens.

A headlight was produced on the basis of the curves of FIGS. 2*a* and 2*b*, with the following parameters:

D=90 mm $y_1$=130 mm $x_1$=30 mm $x_2$=10 mm $x_3$=30 mm=$x_1$ $\theta_L$=35°

The shape of the mirror and of the lens thus obtained is illustrated in FIGS. 3 to 6 of the drawings. The shapes of the various generatrices shown in these figures are to be considered as significant with respect to the present description.

Advantageously, and as shown in FIGS. 3 to 6, the lens 30, shown in solid line in its theoretical form with a square outline, is produced with a circular outline 33 as is shown in dotted lines. In this way, the lens 30 has, when the headlight is extinguished, an appearance (by its smooth faces) and a shape (by its circular outline) which are extremely similar to those of a conventional lens (typically piano-convex) of a headlight of the elliptical type. It is therefore possible, in a front optical block of a vehicle, to juxtapose a headlight according to the invention with a headlight of the elliptical type, the latter both having the same type of appearance when extinguished.

Also in FIGS. 3 to 6, it is observed that the outline 23 of the mirror 20 is cut so as to remove therefrom any area capable of reflecting light outside the circular outline 33 of the lens; at the same time, the size of the mirror is reduced to a strict minimum.

Figure 7:
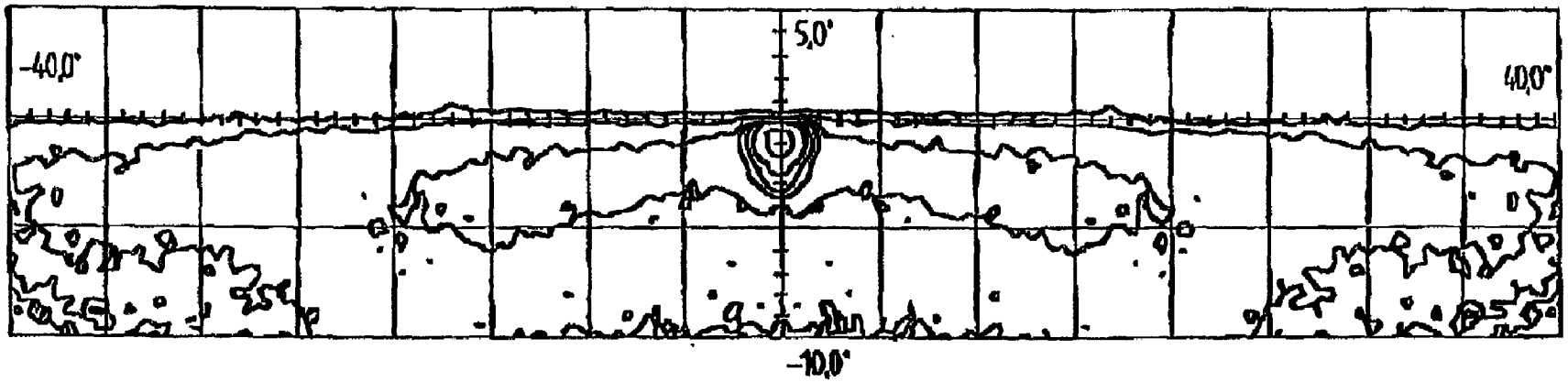
FIG. 7 illustrates, by means of a set of isocandela curves on a projection screen, the appearance of a beam with a cut-off line obtained with the headlight of FIGS. 3 and 6.

It is understood that a headlight which is compact in width and, to a certain degree, in depth, has thus been produced, capable of generating a satisfactory beam, and having an appearance close to that of an elliptical headlight. With regard to the photometric quality of the beam, FIG. 7 shows the appearance thereof by means of a series of isocandela curves.

A large width, good homogeneity and, at the same time, a large point of light along the axis of the road will be noted. This is permitted by the fact that significant areas of the mirror 20 and of the lens 30 are dedicated to obtaining a zero deflection of the light ($\theta=0$ between $x_3$ and D/2), this with relatively small images of the source (such images being smaller the greater the value of x).

Of course, many variants of the present invention may be provided.

Firstly, different widths can be given to the mirror 20 and to the lens 30, it being possible for the width of the mirror to be equal to or less than that of the lens.

Secondly, the lens may be designed, not with a smooth and flat outer face and with an inner face designed as described above, but on the contrary with a smooth and flat inner face and with an outer face designed as described above (or else with both the inner and outer faces worked).

Thirdly, the left and right halves of the mirror and of the lens may or may not be produced symmetrically. In particular, with the present invention, it is possible to foresee generating a beam which is asymmetric and, for example, more spread out in width to the left than to the right, or conversely.

Fourthly, it is possible to produce a beam having an upper cut-off line defined by two planes offset in height, or else by two planes inclined one with respect to the other.

The first example, which typically corresponds to a dipped beam satisfying United States standards, may be obtained by designing the left and right parts of the mirror so as to generate two different cut-off line levels.

The second example, which typically corresponds to a dipped beam complying with European standards, may be obtained by designing a given area of the mirror so that it generates an inclined cut-off line plane. In this case, in order to avoid the deflection element 30 disturbing this cut-off line, it is possible to make sure that that part of the light delimited by a cut-off line of this sort traverses part of the deflection element 30 in an area thereof which is essentially non-deflecting.

Fifthly, the geometrical definition of the reflecting surface of the mirror 20 may be refined by varying, if necessary, some parameters involved in this definition, and especially the "high focus" and "low focus" parameters described, for example, in documents FR-A-2 760 067 or FR-A-2 760 068 in the name of the applicant.

Many other variants may also be provided.

The invention claimed is:

1. A headlight for a motor vehicle, comprising:

a light source;

a mirror; and a transparent optical deflection element disposed in front of the mirror and receiving light flux transmitted directly from the light source and light flux reflected by the mirror, the mirror cooperating with the light source to generate a light beam delimited by an upper cut-off line, and the deflection element providing a generally horizontal spread of the light beam without substantially modifying the vertical distribution of the light beam, the deflection element having a light input face and a light output face which extend substantially across the entire span of the deflection element, wherein one of the faces comprises a flat surface orthogonal to the optical axis of the headlight and the other face comprises a continuous, smooth horizontal directing curvalinear surface so as to present an appearance similar to that of a lens of an elliptical type headlight, and wherein the deflection element has a horizontal cross section satisfying a predetermined law expressing a horizontal angular deflection of the light, from an optical axis of the headlight, of a ray reflected by the mirror, as a function of a first lateral distance, from this same optical axis, of the location of reflection of the reflected ray on the horizontal generatrix.

2. A headlight according to claim 1, wherein for a lateral half of the headlight, the sign of the lateral deflection defined by the pre-determined law remains the same.

3. A headlight according to claim 1, wherein for at least one interval of values of the first lateral distance, the horizontal angular deflection varies monotonically within an interval of values.

4. A method of manufacturing a mirror and an associated deflection element of a headlight for a motor vehicle, the headlight furthermore comprising a light source with which the mirror engages in order to generate a beam delimited by an upper cut-off line, and the deflection element being capable of providing a generally horizontal spread of the light, without substantially modifying the vertical distribution of the light, wherein the method comprises the following steps:

establishing a first law expressing a second lateral distance, from an optical axis of the headlight, of the location of impact of a reflected ray on a transverse reference line located near the deflection element, as a function of a first lateral distance, from this same optical axis, of the location of reflection of the reflected ray on a horizontal generatrix of the mirror, determining the horizontal generatrix of the mirror from this first law, mathematically constructing a reflecting surface of the mirror from the horizontal generatrix and as a function of a vertical cut-off line desired for the beam, machining an impression, from the mathematical construction of the reflecting surface, in order to manufacture the mirror with the reflecting surface, manufacturing the mirror using the impression, establishing a second law expressing a horizontal angular deflection, from the optical axis of the headlight, of the ray reflected by the mirror, as a function of the first lateral distance, determining a horizontal cross section of the deflection element from this second law, mathematically constructing light input and output surfaces of the deflection element, from this horizontal cross section, machining a mould, from the mathematical construction of the input and output surfaces, for the manufacture of the deflection element with the input and output faces, and manufacturing the deflection element by using the mould.

5. A headlight for a motor vehicle, comprising:

a light source;

a mirror; and a transparent optical deflection element disposed in front of the mirror and receiving light flux transmitted directly from the light source and light flux reflected by the mirror, the mirror cooperating with the light source to generate a light beam delimited by an upper cut-off line, and the deflection element providing a generally horizontal spread of the light beam without substantially modifying the vertical distribution of the light beam, the deflection element having a light input face, a light output face and a thickness defined by the distance between the light input face and light output face in a direction parallel to the optical axis of the headlight, wherein each of the light input face and light output face has a continuous, smooth surface which extends substantially across the entire span of the deflection element and the thickness of at least a portion of the deflection element varies in a direction transverse to the optical axis of the headlight, and wherein the mirror has a horizontal generatrix satisfying a predetermined law expressing a second lateral distance, from an optical axis of the headlight, of the location of impact of a reflected ray on a transverse reference line located near the deflection element, as a function of a first lateral distance from this same optical axis, of the location of reflection of the reflected ray on the horizontal generatrix.

6. A headlight according to claim 5, wherein the second lateral distance varies in a non-linear manner from zero to a maximum of the second lateral distance when the first lateral distance varies from zero to a maximum of the first lateral distance.

7. A headlight according to claim 5, wherein for at least one interval of values of the first lateral distance, the second lateral distance is zero.

8. A headlight according to claim 5, wherein for a defined interval of values of the first lateral distance, the second lateral distance varies monotonically in another interval of values.

9. A headlight according to claim 5, wherein the deflection element has a horizontal cross section satisfying a predetermined law expressing a horizontal angular deflection of the light, from an optical axis of the headlight, of a ray reflected by the mirror, as a function of a first lateral distance, from this same optical axis, of the location of reflection of the reflected ray on the horizontal generatrix.

10. A headlight according to claim 9, wherein for at least one interval of values of the first lateral distance, the horizontal angular deflection varies monotonically within an interval of values.

11. A headlight for a motor vehicle, comprising:

a light source;

a mirror; and a transparent optical deflection element disposed in front of the mirror and receiving light flux transmitted directly from the light source and light flux reflected by the mirror, the mirror cooperating with the light source to generate a light beam delimited by an upper cut-off line, and the deflection element providing a generally horizontal spread of the light beam without substantially modifying the vertical distribution of the light beam, the deflection element having a light input face and a light output face which extend substantially across the entire span of the deflection element, wherein a horizontal cross-section of one of the faces comprises a continuous, smooth, flat contour extending orthogonal to the optical axis of the headlight and a horizontal cross-section of the other face comprises a continuous, smooth curved contour which corresponds to a horizontal directed curve, said other face being defined by vertical generatrices bearing on said horizontal directing curve.

* * * * *